United States Patent [19]

Osgood

[11] 4,107,641

[45] Aug. 15, 1978

[54] LIQUID RHEOSTAT

[76] Inventor: George M. Osgood, 4474 SW. Arthur Way, Portland, Oreg. 97201

[21] Appl. No.: 699,614

[22] Filed: Jun. 24, 1976

[51] Int. Cl.[2] ..... H01C 1/082

[52] U.S. Cl. ..... 338/55; 137/341; 165/61; 165/DIG. 3; 338/86; 338/222

[58] Field of Search ..... 338/27, 38, 44, 56, 338/55, 86, 94, 151, 222; 417/60; 165/61, 108, DIG. 3; 137/340, 341

[56] References Cited

U.S. PATENT DOCUMENTS

| | | | |
|---|---|---|---|
| 1,376,470 | 5/1921 | Slepian | 338/86 |
| 1,745,510 | 2/1930 | Seeger | 338/86 X |
| 1,800,821 | 4/1931 | Edison | 338/222 X |
| 2,734,977 | 2/1956 | Schaelchlin et al. | 338/56 |
| 3,609,626 | 9/1971 | Beyrard | 338/86 X |

*Primary Examiner*—C. L. Albritton
*Attorney, Agent, or Firm*—Kolisch, Hartwell, Dickinson & Stuart

[57] ABSTRACT

A liquid rheostat includes a conductive element which surrounds multiple electrodes. The element provides a multiplicity of current paths between the electrodes at a given depth of electrolyte solution thus decreasing current concentration of the electrodes. In order to further decrease current concentration, cylindrical electrodes are used. In a second embodiment, the liquid rheostat and an electrolyte storage container are disposed so as to surround a fluid transport pipe of a pumping system, the fluid being transported in the pipe serving to cool the electrolyte. The rheostat and storage container combined with the pipe provide a compact arrangement for saving space in a pump installation.

11 Claims, 4 Drawing Figures

LIQUID RHEOSTAT

BACKGROUND OF THE INVENTION

The present invention relates to liquid rheostats, and more particularly to an improved liquid rheostat having cylindrical electrodes which are surrounded within a solution of electrolyte by an electroconductive element. The element provides portions of current paths for diffusing the current between the electrodes to thereby substantially reduce current concentration and electrode erosion.

Liquid rheostats are known to vary the speed of induction motors by varying the resistance in the rotor circuit. Such rheostats typically take the form of a container having electrodes disposed within an electrolyte solution held by the container. When the solution is varied in depth, the resistance between the electrodes is varied, i.e., as the solution level decreases the resistance increases and as the solution level increases the resistance decreases. Additionally, prior art liquid rheostats have generally operated under the principle that electrode spacing is responsible for a change in resistance. Such rheostats have a number of significant drawbacks.

First of all, prior art liquid rheostats are generally quite large and bulky for the reason that large electrode surface areas are required to prevent current concentrations on the electrodes from becoming excessive. High current concentrations will accelerate erosion of the electrodes. Thus, prior art devices have provided electrodes having large surface areas in order to minimize current densities. However, such large liquid rheostats are bulky and heavy in addition to being expensive to construct. Furthermore, large rheostats are undesirable for applications such as underground pumping stations where space is often limited.

Because prior art liquid rheostats operate on the principle that electrode spacing, and solution level are responsible for resistance between electrodes, various complex electrode configuration have been proposed. For instance, it has been suggested to provide tapering electrode edges in order to vary the distance between electrodes as the electrolyte solution is raised or lowered in order to vary the resistance. Such complex shapes may be difficult and expensive to manufacture. Additionally, current tends to concentrate along sharp or angular electrode edges, thus accelerating erosion and shortening electrode life.

Another problem present in prior art liquid rheostats resides in the methods used to cool the electrolyte solution. Because current passes through the solution, heat is generated which must be removed. For instance, in pumping installations where resistance in the rotor circuit of a pump motor is controlled by means of a liquid rheostat, liquid electrolyte is cooled by connecting the rheostat through a series of supply and return pipes to a heat exchanger which encircles the discharge pipe of the pump. Because the liquid rheostat is separately situated from the discharge pipe, such pumping installations may require a significant amount of space. If the pumping installation is to be underground, as is often the case, the requirement of a large amount of space is undesirable from a construction and cost standpoint.

SUMMARY OF THE INVENTION

The present invention provides a liquid rheostat in which upright electrodes are disposed within an electrolyte solution reservoir wherein an electroconductive element surrounds the electrodes. When the electrodes are supplied with current, the current may pass from one electrode directly to another through the electrolyte solution, or current may additionally pass from one electrode through the solution to the element for travel therealong to pass through the solution again to another electrode. Such a construction provides for an almost infinite number of current paths between the electrodes. Because there is a multiplicity of current paths, current does not tend to concentrate on any particular surface region of the electrodes.

It is a general object of the present invention to provide a liquid rheostat which includes an electroconductive element surrounding electrodes so that multiple current paths exist between the electrodes and along the element to reduce current densities on the electrodes.

Another object of the present invention is to provide a liquid rheostat in which the electrodes are generally non-angular in cross section so that sharp edges are not presented between electrodes. More particularly, the present invention provides a liquid rheostat having generally cylindrical electrodes and a generally cylindrical electroconductive element which surrounds the electrodes. Such a construction provides the maximum amount of current conducting surface within a given rheostat volume. Electrode erosion is inhibited because of the absence of angular edges.

A further object of the present invention is to provide a liquid rheostat in which the resistance between electrodes is independent of electrode spacing. Because the electroconductive element provides a multiplicity of current paths between electrodes, current tends to flow in all directions between the electrodes and over the element irrespective of electrode spacing.

It is yet another object of the present invention to provide a liquid rheostat in which the resistance between electrodes is inversely proportional to the amount of submerged electrode area.

In a second embodiment of the present invention, it is contemplated that the above described liquid rheostat may be situated so as to encircle a discharge pipe of a pumping installation so that heat may be transferred from the electrolyte solution to the fluid being transported through the discharge pipe. A plurality of elongate electrodes are disposed in the container with the aforementioned electroconductive element.

According to the second embodiment of the present invention, it is an object to eliminate conventional heat exchangers which surround a pump discharge pipe and the resultant piping between a liquid rheostat and the discharge pipe. Consequently, with a liquid rheostat surrounding a discharge pipe, the amount of space required for a pumping installation is substantially reduced, resulting in significant savings in installation costs, maintenance, etc.

Still another object of the present invention according to the second embodiment is to provide an electrolyte storage container disposed directly beneath the electrolyte rheostat, the storage container and rheostat both formed about the fluid discharge pipe so that a compact, integral package results. Such a construction will further provide space reduction and installation savings.

These and additional objects of the present invention will become more readily apparent from a consideration of the drawings and the following detailed description.

BRIEF DESCRIPTION OF THE DRAWINGS

Novel features of the improved liquid rheostat in accordance with the present invention will be more readily understood from a consideration of the following description taken together with the accompanying drawings, in which certain preferred adaptations are illustrated with the various parts thereof identified by suitable reference characters in each of the views, and in which.

DETAILED DESCRIPTION OF THE INVENTION

Figure 2:
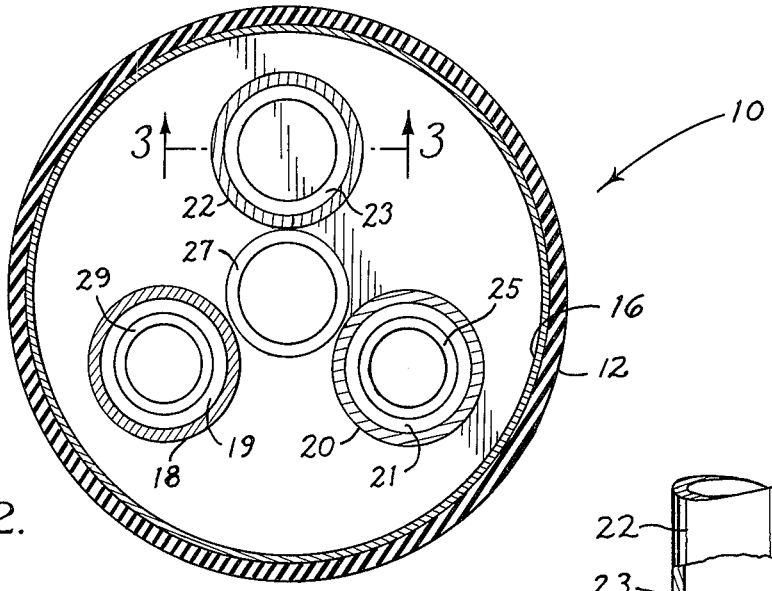
FIG. 2 is a view taken along lines 2—2 of FIG. 1.
Figure 1:
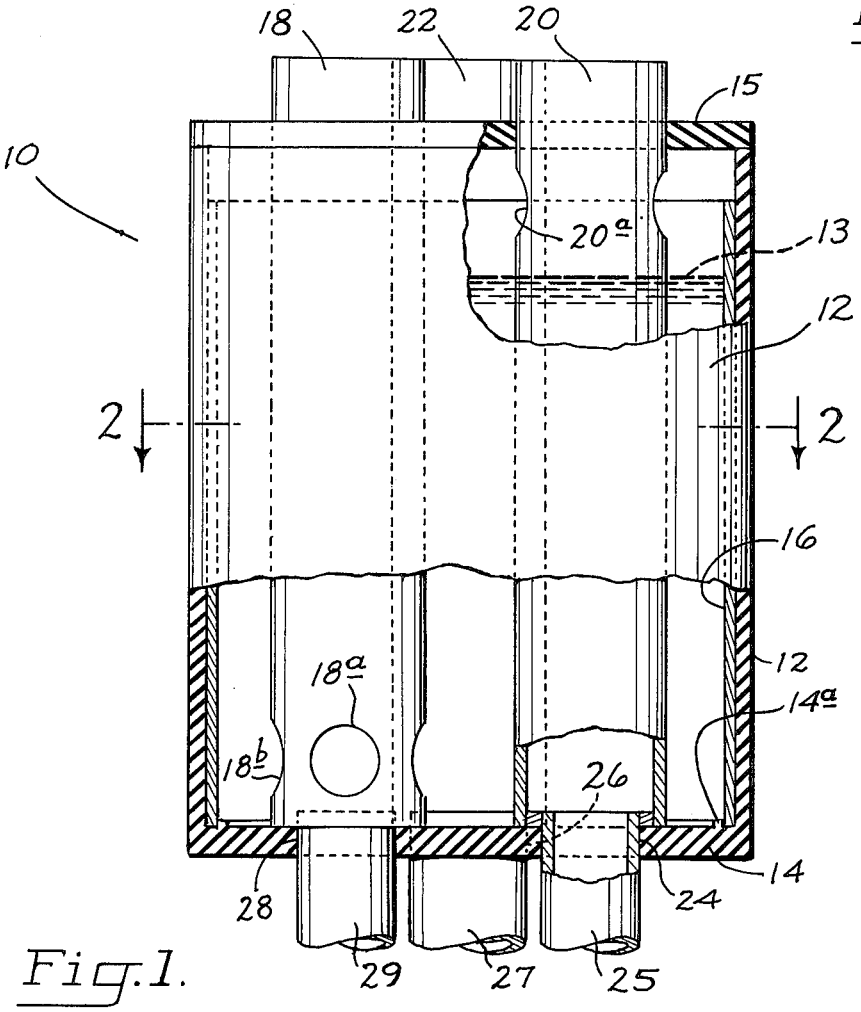
FIG. 1 is a side view, partially cut away, of a liquid rheostat according to the present invention.

With reference directed initially to FIGS. 1 and 2 of the drawings, a liquid rheostat in accordance with the present invention is generally designated at 10. The rheostat 10 includes a nonconductive container 12 having a bottom 14 and a top 15. The container 12 is illustrated as being cylindrical and includes an annular lip 14*a* adjacent to the bottom 14. Supported interiorly of the lip 14*a* is an electroconductive means or element 16 which surrounds the interior of the container 12.

Figure 3:
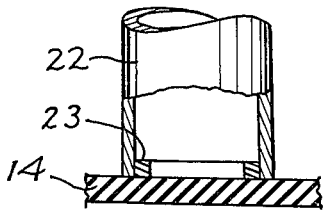
FIG. 3 is a view taken along lines 3—3 of FIG. 2.

A plurality of elongate, hollow cylindrical electrodes 18, 20 and 22 are disposed within the container 12 in substantially upright position. The top 15 is provided with apertures to permit extension therethrough of the electrodes 18, 20 and 22 so that the electrodes may be connected to an electrical power source. Each of the electrodes 18, 20 and 22 is supported from lateral movement by annular retainers 19, 21 and 23, respectively. For instance, from a consideration of FIG. 3, it can be seen that the electrode 22 is situated to encircle the annular retainer 23 such that the electrode 22 will not shift laterally over the retainer 23. The retainers 19, 21 and 23 are affixed to the bottom 14.

The electrodes 18, 20 and 22 are provided with connections (not shown) such that the electrodes may be connected to a source of electric current. For instance, the electrodes 18, 20 and 22 may be appropriately connected to the rotor circuit of a 3-phase induction motor such that the resistance in the rotor circuit may be varied to alter the speed of the motor. Such a motor may be used, for instance, in an underground sewage pumping installation. The liquid rheostat 10 will hold varying levels of an electrolyte solution 13 in order to selectively submerge and vary the resistance between the electrodes 18, 20 and 22. The bottom 14 of the rheostat 10 is provided with apertures 24, 26 and 28 through which an overflow drain pipe 25, a return pipe 27 and a pipe 29 depend. The electrode 22 rests upon the bottom 14, and does not have a pipe depending therefrom. The pipes 25, 27 and 29 are secured to the bottom 14.

In a typical pumping installation, the pipe 25 is connected to an electrolyte solution storage compartment (not shown). The pipe 27 is connected to a heat exchanger (not shown). The heat exchanger encircles a discharge pipe of a pump and is connected to a circulating pump (not shown) which circulates hot electrode from the electrolyte storage container through the heat exchanger back through the return pipe 27 into the container 12. The electrode 18 is provided with drain apertures 18*a*, 18*b* and the electrode 20 is provided with overflow drain apertures 20*a*.

As electrolyte solution is introduced through the pipe 27 into the container 12, some of the solution will initially drain through the apertures 18*a*, 18*b* to a regulating valve (not shown). The regulating valve controls the depth of the solution 13 to selectively submerge the electrodes 18, 20, 22 and the element 16 depending upon desired pump motor operating speed. As the solution 13 is increased in depth in the container 12, the resistance between the electrodes is decreased. The drain apertures 20*a* permit the electrolyte solution 13 to reach a predetermined depth, whereupon the solution 13 will drain through the hollow electrode 20 and through the overflow drain pipe 25 back to the storage compartment.

The rheostat 10 of the present invention provides certain unexpected advantages. Assuming that the electrodes 18, 20 and 22 are connected to a power source, at a given electrolyte solution depth electric current will pass directly through the solution from one electrode to another. For instance, with the electrolyte solution 13 at a given depth, such as shown in FIG. 1, current may travel directly between each of the electrodes 18, 20 and 22. However, in addition to direct electrolyte solution current travel between the electrodes, current may also travel from an electrode through the solution to the electroconductive element 16 for travel therealong and through the solution again to another electrode. The element 16 provides portions of current paths between electrodes, and at a given depth of the electrolyte solution, there will be multiple current paths between the electrodes in addition to those paths directly between electrodes because of the element 16. As a consequence, current will not be concentrated at any one electrode or on a particular surface region of any one electrode. Additionally, because the electrodes are cylindrical, current does not have angular edges upon which to concentrate and thus erosion is substantially inhibited. While the element 16 is illustrated in FIG. 2 as being continuous, such element could in fact, be constructed in sections.

The resistance between the electrodes has been found to be relatively constant for a given electrolyte solution depth regardless of electrode spacing. For instance, the electrodes 18, 20 and 22 could be situated further or closer together than illustrated in FIG. 2 and the resistance between such would remain substantially the same for a given electrolyte solution depth. Such is the resullt because the electroconductive element 16 provides a region over which a multiplicity of additional current paths diffuses the current between the electrodes. The diffusion would occur regardless of electrode spacing.

Figure 4:
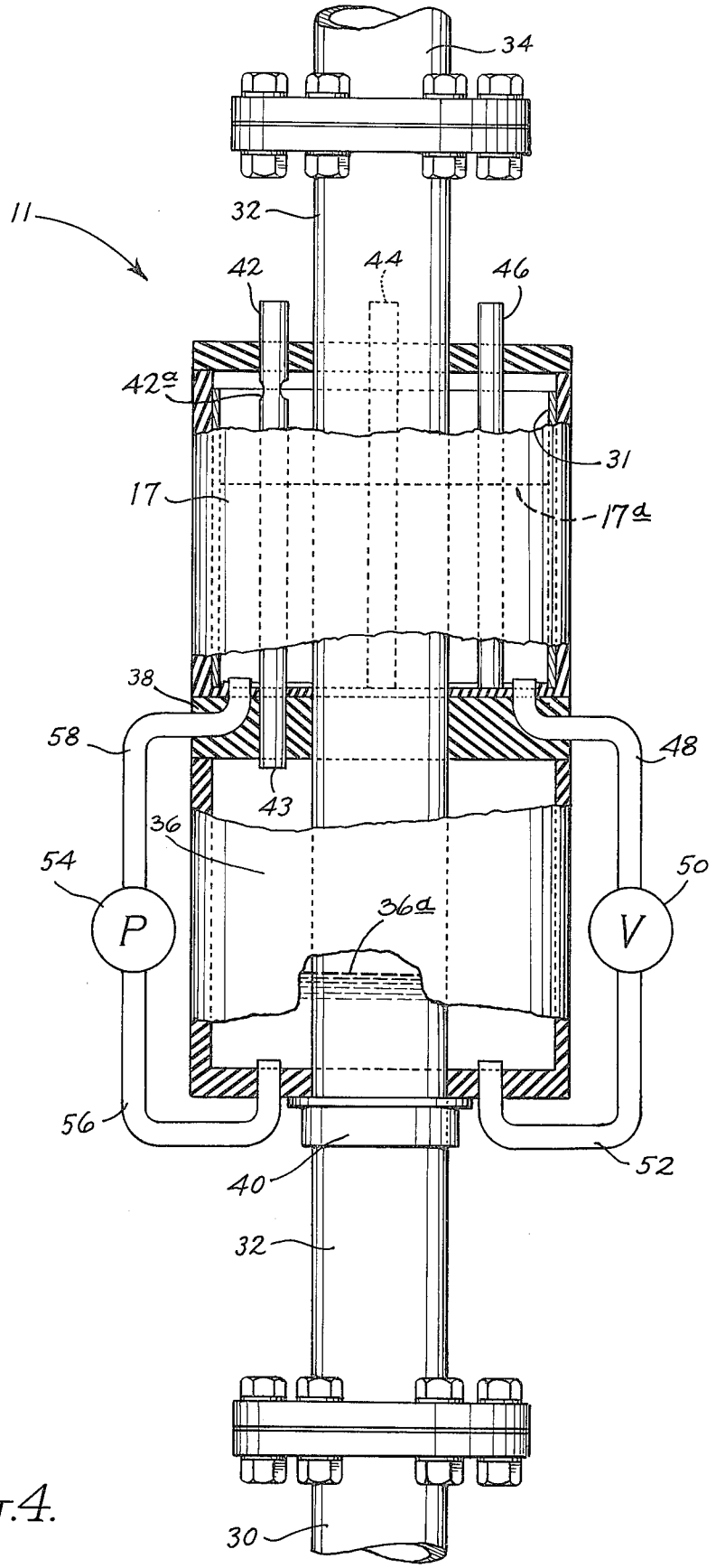
FIG. 4 is a side view, partially cut away, of the liquid rheostat according to a second embodiment of the present invention installed so that the rheostat, a solution storage container and a fluid transport conduit are arranged to form a compact unit.

A second embodiment of the present invention is illustrated in FIG. 4 and contemplates combining a liquid rheostat and an electrolyte solution container about a fluid transport conduit. Such a construction utilizes the conduit for cooling the electrolyte solution, thereby eliminating conventional heat exchangers used in prior art pumping installations. Furthermore, it is often the case that pumping installations are located underground where space is at a premium. Heretofore, it has been necessary to provide a substantial underground area for a separate fluid transport or discharge pipe, a pump, motor and a liquid rheostat with the required controls. With the embodiment shown in FIG. 4, a liquid rheostat may be provided with an electrolyte solution tank wherein both are disposed about a discharge pipe, resulting in a compact arrangement which utilizes substantially less space than prior systems.

Specifically, in FIG. 4 there is shown a portion of a fluid transport conduit 30 which is connected to a discharge pump (not shown). Conduit 30 is connected to a conduit 32 which is in turn connected to another conduit 34. Encircling conduit 32 a liquid rheostat 11. The liquid rheostat 11 includes a container 17 below which is disposed an electrolyte solution storage container 36. The container 17 is separated from the storage container 36 by an intermediate section 38. A suitable retaining member 40 is provided to support the liquid rheostat 11 and the storage container 36, as such will be disposed vertically in a pumping installation.

The liquid rheostat 11 includes three electrodes 42, 44 and 46 for connection to the rotor circuit of a three phase induction motor. The electrode 42 is provided with overflow drain holes **42*a* and an overflow drain pipe 43. A pipe 48 depending from the bottom of container 17 connects a regulating valve 50 to a return pipe 52. The return pipe 52 extends into the storage container 36. A pump 54 is operable to pump electrolyte solution from the container 36 through pipes 56 and 58 into the rheostat container 17. The regulating valve 50 is connected to a bubbler or the like to sense pressure for selective actuation to drain electrolyte from container 17 as requirements of a particular installation dictate. Solution levels in the containers 17, 36 are shown at 17*a* and 36*a*, respectively for a given resistance between the electrodes 42, 44 and 46**.

The liquid rheostat 11 also incorporates a conductive element 31 and a multiplicity of current paths exist between the electrodes and along the element 31 for a given solution depth. In addition, further portions of current paths between electrodes may exist on the discharge conduit 32, thus further decreasing current concentration.

From the above, it can be readily appreciated that the second embodiment of the present invention provides a novel construction in which a fluid transport conduit serves to cool the electrolyte and also provides additional current paths for current flow between electrodes. Thus, the need for external heat exchangers is eliminated, resulting in a compact, economical and space saving arrangement.

While the invention has been particularly shown and described with reference to the foregoing preferred embodiments thereof, it will be understood by those skilled in the art that other changes in form and detail may be made therein without departing from the spirit and scope of the invention as defined in the appended claims.

What is claimed is:

1. A liquid rheostat comprising:

reservoir means for holding an electrolyte solution;

a plurality of spaced-apart, elongate electrodes disposed in said reservoir means, said electrodes having lengths adapted to be selectively submerged in the solution; and electroconductive means disposed in said reservoir means spaced from and substantially surrounding said electrodes at least about the electrode lengths adapted to be selectively submerged, said electrodconductive means also adapted to be selectively submerged in the solution for providing a portion of path along which current may be conducted between submerged electrodes.

2. A liquid rheostat as defined in claim 1 wherein said electrodes have a continuous, generally non-angular cross section substantially over the electrode length adapted to be selectively submerged.

3. A liquid rheostat as defined in claim 2 wherein said electrodes are generally cylindrical.

4. A liquid rheostat as defined in claim 3 wherein at least one of the electrodes is hollow throughout a portion of its length and includes means for permitting solution to drain through the hollow portion when the solution attains a predetermined depth in said reservoir means.

5. A liquid rheostat as defined in claim 1 wherein said electroconductive means is generally cylindrical.

6. A liquid rheostat comprising:

reservoir means for holding an electrolyte solution;

three spaced-apart, elongate electrodes disposed in said reservoir means, said electrodes being generally cylindrical and having lengths adapted to be selectively submerged in the solution; and electroconductive means disposed in said reservoir means spaced from and substantially surrounding said electrodes, said electroconductive means being generally cylindrical and adapted to be selectively submerged in the solution for providing a portion of a path along which current may be conducted between submerged electrodes.

7. A combination fluid transport conduit and liquid rheostat, said rheostat including a reservoir means for holding an electrolyte solution and a plurality of spaced-apart elongate electrodes, said electrodes being disposed in said reservoir means and having lengths adapted to be selectively submerged in the solution, wherein said reservoir means substantially surrounds said conduit so that heat transfer may be effectuated between a fluid being transported through said conduit and the solution.

8. The combination as defined in claim 7 wherein an electrolyte solution storage means is disposed about said conduit adjacent to said rheostat for selectively supplying and withdrawing solution to said reservoir means.

9. The combination as defined in claim 7 wherein said electrodes are generally cylindrical have their longitudinal axes generally parallel to the longitudinal axis of said conduit.

10. The combination as defined in claim 7 wherein an electroconductive means is disposed in said reservoir means adjacent to and spaced from said electrodes, said electroconductive means adapted to be selectively submerged in the solution for providing a portion of a path along which current may be conducted between submerged electrodes.

11. The combination as defined in claim 10, wherein said electroconductive means is generally cylindrical.

* * * * *